US011445753B2

(12) United States Patent
Ouyang

(10) Patent No.: US 11,445,753 B2
(45) Date of Patent: Sep. 20, 2022

(54) CONDUCTIVE COMPONENT, OUTPUT ELECTRODE, AND ELECTRONIC CIGARETTE HAVING SAME

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 261 days.

(21) Appl. No.: 16/830,400

(22) Filed: Mar. 26, 2020

(65) Prior Publication Data

US 2020/0305502 A1 Oct. 1, 2020

(30) Foreign Application Priority Data

Apr. 1, 2019 (CN) ..... 201910256194.4

(51) Int. Cl.
*A24F 40/40* (2020.01)
*A24F 47/00* (2020.01)

(52) U.S. Cl.
CPC ..... *A24F 40/40* (2020.01); *A24F 47/00* (2013.01)

(58) Field of Classification Search
CPC ..... A24F 40/40; A24F 47/00; A24F 40/10
See application file for complete search history.

(56) References Cited

U.S. PATENT DOCUMENTS

| | | | | |
|---|---|---|---|---|
| 10,517,334 | B1 * | 12/2019 | Volodarsky | A24F 1/30 |
| 10,806,183 | B2 * | 10/2020 | Liu | A24F 40/44 |
| 11,103,008 | B2 * | 8/2021 | Liu | A24F 40/42 |
| 11,191,303 | B2 * | 12/2021 | Fu | H05B 3/44 |
| 2014/0060524 | A1 * | 3/2014 | Liu | H05B 3/0014 128/200.14 |

(Continued)

FOREIGN PATENT DOCUMENTS

| | | | |
|---|---|---|---|
| GB | 2534855 | A | 8/2016 |
| GB | 2561429 | A | 10/2018 |
| WO | 2015/149311 | A1 | 10/2015 |

OTHER PUBLICATIONS

European Patent Office, Search Report and Opinion, European Patent Application No. 20166584.1, 8 pages, dated Sep. 22, 2020.

*Primary Examiner* — Truc T Nguyen
(74) *Attorney, Agent, or Firm* — Thompson Hine LLP

(57) ABSTRACT

The present disclosure provides a conductive component for an output electrode of an electronic cigarette. The conductive component can include a first conductive element, a second conductive element, and a seal element. The first conductive element and the second conductive element tightly clamps the seal element, and the first conductive element passes through the seal element, fixes and establishes electrical connection with the second conductive element. The unclamped part of seal element extends outwards when an extending end of the seal element is fixed the seal element partly separates the first conductive element and the second conductive element so that the first conductive element is exposed and electronically connected with the external load, whereas the second conductive element is covered by the seal element within the device and electronically connected with the internal components of the device.

20 Claims, 6 Drawing Sheets

(56) References Cited

U.S. PATENT DOCUMENTS

| | | | | |
|---|---|---|---|---|
| 2018/0206555 | A1* | 7/2018 | Chen | H01R 13/521 |
| 2018/0279676 | A1* | 10/2018 | Kalish | A24F 40/485 |
| 2019/0046745 | A1* | 2/2019 | Nettenstrom | A61M 15/06 |
| 2019/0183176 | A1* | 6/2019 | Liu | A24F 40/05 |
| 2019/0364967 | A1* | 12/2019 | Wu | A24F 40/42 |

* cited by examiner

CONDUCTIVE COMPONENT, OUTPUT ELECTRODE, AND ELECTRONIC CIGARETTE HAVING SAME

CROSS-REFERENCE TO RELATED APPLICATION

This application claims priority to Chinese Patent Application No. 201910256194.4, filed on Apr. 1, 2019. The disclosure of the foregoing application is incorporated herein by reference in its entirety.

TECHNICAL FIELD

The present disclosure relates to the technical field of electronic cigarettes, and more particularly, a conductive component, an output electrode having the same conductive component, and an electronic cigarette having the same output electrode.

BACKGROUND

An e-cigarette is also called an electronic cigarette, which is mainly used for smoking cessation and replacement of cigarettes. It has similar appearance and taste to traditional cigarettes but with even more flavors. Smoking electronic cigarettes may result in vapor that tastes and feels like traditional cigarette smoke. Because an electronic cigarette does not have the tobacco tar, smoke particles, and other toxic components of the traditional tobacco cigarettes, electronic cigarettes have gradually replaced traditional cigarettes and rapidly gained popularity by consumers.

Currently, electronic cigarettes are often installed with electrode components to establish electrical connection with atomizers. Meanwhile, to ensure that electrode components are seamlessly integrated with atomizers, often an elastic member such as a spring will be added to the electrode component so that the electrode component can move and rebound to a certain degree. However, often the movement of such electrode component will lead to a gap between the surrounding surface of the electrode component and the insulation part, which in turn causes the electronic cigarette's e-liquid to leak within the device and to corrode the circuit board. This often results in short-circuit safety issue.

SUMMARY

In view of the above, the present disclosure aims to provide an electrode component that can strengthen the liquid-resistance of electronic cigarettes.

To achieve the above purpose, the present disclosure provides a conductive component for an electronic cigarette. The conductive component includes a first conductive element, a second conductive element, and a seal element. One of the said first conductive element and the second conductive element passes through the seal element, fixes and establishes electrical connection with the other one, and clamps the seal element tightly, and the unclamped part of the seal element extends outwards.

When an end of the extending seal element is fixed by the electronic cigarette's internal structure, the seal element partly separates the first conductive element and the second conductive element so that the first conductive element is exposed and electronically connected with an external load, whereas the second conductive element is covered by the seal element within the electronic cigarette and electronically connected with an internal components of the electronic cigarette.

In some embodiments, the seal element is made of flexible material. In some embodiments, the seal element includes a sealing part and a fixing part. The sealing part can be clamped by the first conductive element and the second conductive element, and the extending end of the seal element can be fixed by an internal structure of the electronic cigarette and can form the fixing part. In some embodiments, the elastic deformation part can be formed between the sealing part and the fixing part, and can cover the second conductive element inside the electronic cigarette device.

In some embodiments, one of the first conductive element and the second conductive element has an inserting hole, and the other has a connecting bolt. In some embodiments, the seal element includes an avoidance hole corresponding to the connecting bolt, and the connecting bolt can pass through the avoidance hole and into the inserting hole and is configured to fix the first conductive element and the second conductive element. In some embodiments, the sealing part is tightly clamped between the first conductive element and the second conductive element.

In some embodiments, the inserting hole is a stepped sinking hole. In some embodiments, the sealing part can include a seal tube placed at an edge of the avoidance hole and can be configured to be inserted into a large-diameter of the stepped sinking hole. In some embodiments, the connecting bolt can pass through the avoidance hole and into the seal tube. In some embodiments, the seal tube can contact an outer surface of the connecting bolt elastically.

In some embodiments, the connecting bolt has a shaft shoulder, the outer diameter of which is larger than the small-diameter of the inserting hole. In some embodiments, when the connecting bolt passes through the avoidance hole and the shaft shoulder contacts the edge of the small-diameter of the stepped sinking hole, the shaft shoulder is accommodated into the large-diameter of the inserting hole and an outer surface of the shaft shoulder can tightly match against the inner wall of the seal tube.

In some embodiments, a stop collar is provided on the edge of the small-diameter of the inserting hole at a space between an outer surface of the stop collar and an inner wall of the large-diameter of the inserting hole. In some implementations, the stop collar forms a holding space such that when the seal tube of the seal element is inserted into the large-diameter of the inserting hole, an end of the seal tube is inserted into the holding space and contacts the stop collar elastically.

In some embodiments, the diameter of the connecting bolt gradually decreases from the protruding head to the protruding end; or else that the protruding end of connecting bolt has a inserting head, a diameter of which is smaller than a diameter of the connecting bolt, and a connecting part between the inserting head and the connecting bolt has a transitioning cambered surface.

In some embodiments, the first conductive element includes a connecting hole provided with female threads, and the second conductive element has a connecting tube provided with male threads. In some embodiments, the male threads are at a first end of the connecting tube, where a sealing part of the seal element is sleeved at a second end of the connecting tube. In some embodiments, the sealing part can be tightly clamped between the first conductive element and the second conductive element when the first conductive element is connected with the second conductive element via a thread meshing.

In some embodiments, the elastic deformation part includes a circular truncated cone shape.

In some embodiments, the conductive component includes a clamping ring, which encloses the extending end of the seal element.

In some embodiments, the seal element includes a receiving groove on a side that faces the second conductive element, and at least part of the clamping ring is tightly fitted in the receiving groove.

The present disclosure further provides an output electrode of an electronic cigarette. The output electrode includes a conductive component. The conductive component includes a first conductive element, a second conductive element, and a seal element. In some embodiments, one of the said first conductive element and the second conductive element can pass through the seal element, and can be configured to fix and establish an electrical connection with the other, and clamp the seal element tightly. In some embodiments, the unclamped part of the seal element can extend outwards.

In some embodiments, when an extending end of the seal element is fixed, the seal element can partly separate the first conductive element and the second conductive element so that the first conductive element is exposed and electronically connected with an external load, whereas the second conductive element is covered by the seal element within the electronic cigarette and electronically connected with an internal components of the electronic cigarette.

The present disclosure further provides an electronic cigarette including an output electrode. The output electrode includes a conductive component. The conductive component includes a first conductive element, a second conductive element, and a seal element. In some embodiments, one of the said first conductive element and the second conductive element can pass through the seal element and can be configured to fix and establish an electrical connection with the other, and clamp the seal element tightly. In some embodiments, the unclamped part of the seal element extends outwards.

In some embodiments, when an extending end of the seal element is fixed, the seal element partly separates the first conductive element and the second conductive element so that the first conductive element is exposed and electronically connected with an external load, whereas the second conductive element is covered by the seal element within the electronic cigarette and electronically connected with an internal components of the electronic cigarette.

The present disclosure provides a conductive component, which uses one of the first conductive element and the second conductive element to pass through the seal element, and can be configured to fix and establish electrical connection with the other. In some embodiments, when an extending end of the seal element is fixed, the first conductive element is exposed to establish electrical connection with an external load, and the second conductive element is covered by the seal element within the electronic cigarette. The electronic cigarette connects with the external load electronically through the first conductive element and the second conductive element. In some embodiments, the first conductive element and the second conductive element can tightly clamp the seal element so that the seal element will be seamlessly matched against the first conductive element, which effectively prevents the leakage of e-liquid through the gaps in between.

BRIEF DESCRIPTION OF THE DRAWINGS

For a better understanding of the technical scheme of the embodiment of the present disclosure or in the prior art, the following paragraphs briefly illustrate the drawings necessary in the description of the embodiment or in the prior art. Apparently, the following drawings are mere some embodiment of the present disclosure. For the ordinary skilled persons in this field, one may obtain other drawings without any creative work based on the structure of the following drawings.

Figure 1:
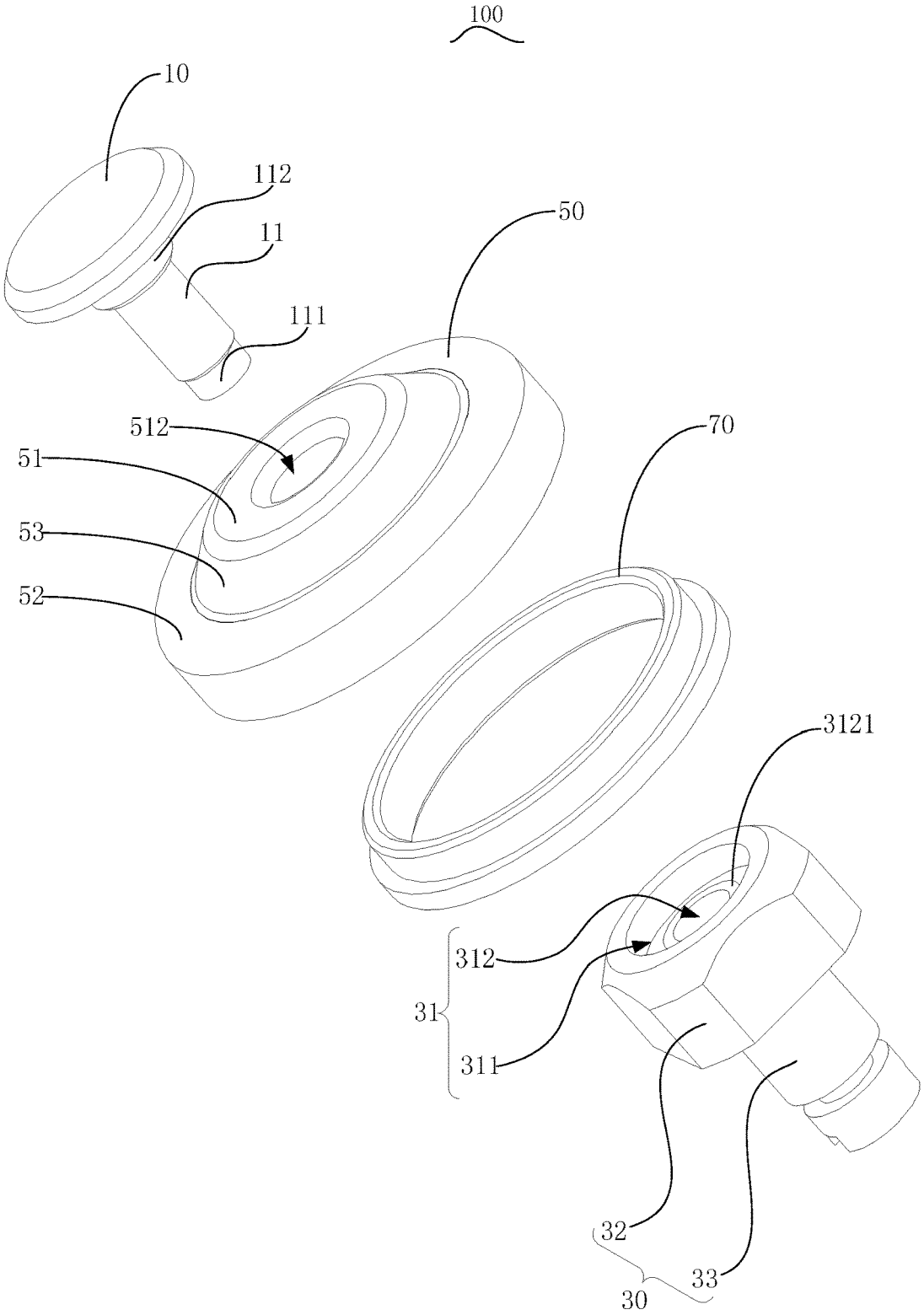
FIG. 1 is a schematic diagram of the connecting structure of the conductive component using for an electronic cigarette in present disclosure.

Description of reference numbers in the drawings:

| Reference Number | Name of Part |
|---|---|
| 100 | Conductive component |
| 10 | First conductive element |
| 11 | Connecting bolt |
| 111 | Inserting head |
| 112 | Shaft shoulder |
| 113 | Transitioning cambered surface |
| 30 | Second conductive element |
| 31 | Inserting hole |
| 311 | Large-diameter of the inserting hole |
| 312 | Small-diameter of the inserting hole |
| 3121 | Stop collar |
| 32 | Larger end |
| 321 | Accommodating groove |
| 33 | Smaller end |
| 331 | Wiring groove |
| 332 | Clipping groove |
| 50 | Seal element |
| 51 | Sealing part |
| 511 | Seal tube |
| 512 | Avoidance hole |
| 52 | Fixing part |
| 521 | Receiving groove |
| 53 | Elastic deformation part |
| 70 | Clamping ring |
| 200 | Electrode holder |
| 210 | Installation hole |
| 300 | Insulation element |
| 400 | Locking cover |
| 1000 | Output electrode |

The implementation of the goals, the function features and the advantages of the present disclosure are described below in further detail in conjunction with the embodiment with reference to the drawings.

DETAILED DESCRIPTION

A clear and complete description as below is provided for the technical scheme in the embodiment of the present disclosure in conjunction with the drawings as follows. The embodiment described hereinafter, however, obviously represent some of the possible embodiment of the present disclosure, rather than all the possible embodiment. Any other embodiment obtained by the ordinary skilled persons in this field based on the structure of the following drawings without any creative work are intended to be included in the scope of protection of the present disclosure.

It should be noted that all directional indications (e.g., top, bottom, left, right, front, behind, etc.) in the embodiment of the present disclosure are merely to illustrate the relative position and the relative motion condition among each component in a particular state (as shown in the drawings). If the particular state changes, the directional indication shall change accordingly.

In addition, any terms referencing "first" and "second" in the present disclosure are intended to describe the matters, and are not indicative of, expressly or implicitly, the relative importance or the quantity of the designated technical features of those descriptions. Thus, any features that have "first" or "second" references may specifically or implicitly include at least one such feature. Moreover, technical schemes of each embodiment of the present disclosure can be combined mutually; however, it must be carried out on the condition that the ordinary skilled person in this field can implement the combination. To the extent that the technical schemes have a conflict to each other or cannot be implemented, such combination of the technical schemes shall be considered as not existent and thus are not intended to be included in the scope of protection of the present disclosure.

In the present disclosure, unless expressly defined and limited otherwise, terms such as "connect" and "fixed" shall be broadly construed. For example, "fixed" may mean a fixed connection, or a disposable connection, or as a whole; it may also mean mechanical connection, or electronic connection; it may mean direct connection, or indirect connection with media in between; it may mean inner connection between two components, or the interaction between the two components, unless expressly defined otherwise. An ordinary skilled person in this field may construe the particular meaning of each of such terms based on the specific descriptions in the present disclosure.

The present disclosure provides an electronic cigarette, which includes a power supply equipment and an atomizer (not shown in the drawing). If the atomizer and the power supply equipment are not detachable and integrated in one electronic cigarette device, the electronic cigarette in the present disclosure defines as the combination of the atomizer and the power supply equipment as a whole. If the two are detachable in the electronic cigarette device, the electronic cigarette in the present disclosure refers to the power supply equipment. The present disclosure uses a detachable electronic cigarette device as an example, in which the atomizer has an air channel, an e-liquid compartment, a heating element, and a conductive electrode. The heating element includes a heater and an e-liquid transmitter, and the e-liquid transmitter directly touches the heater such that the e-liquid transmitter is partly placed in the e-liquid compartment and the heater is partly placed in the air channel and is electronically connected to the conductive electrode. When the atomizer is installed in the power supply equipment, the conductive electrode establishes electrical connection with the output electrode 1000 of the power supply equipment. The heater will heat the e-liquid sucked from the e-liquid compartment under the electric current from the power supply equipment and generate vapor for the consumers to inhale through the air channel.

Referring to FIG. 1 to FIG. 6, the output electrode 1000 of electronic cigarette includes an electrode holder 200 with an installation hole 210, an insulation element 300, and a conductive component 100. The electrode assembly of the atomizer is installed in the installation hole 210 and establishes electrical connection with the electrode holder 200 and the conductive component 100. The conductive component 100 includes a first conductive element 10, a second conductive element 30, and a seal element 50. One of the first conductive element 10 and the second conductive element 30 passes through the seal element 50, fixes and establishes electrical connection with the other. The seal element 50 is partly clamped by the first conductive element 10 and the second conductive element 30, whereas the unclamped part of the seal element extends outwards. When an extending end of the seal element 50 is fixed by the internal structure of the electronic cigarette, the seal element 50 partly separates the first conductive element 10 and the second conductive element 30 so that the first conductive element 10 is exposed from the sealing element 50 for external load to connect with electronically, whereas the second conductive element 30 is covered by the seal element 50 within electronic cigarette to electronically connect with the internal components of electronic cigarette. Here, in this embodiment, the electrode holder 200 is exposed outside to form the negative electrode of the output electrode 1000 of electronic cigarette. The second conductive element 30 of the conductive component 100 passes through the insulation element 300 and is covered by the seal element 50 within the electronic cigarette to establish electrical connection with the internal components of the electronic cigarette. One end of the first conductive element 10 is accommodated within the installation hole 210, while the other end passes through the seal element 50 and fixes and establishes electrical connection with the second conductive element 30 such that it forms the positive electrode of the output electrode 1000 of electronic cigarette. In some embodiments, the first conductive element 10 and the second conductive element 30 tightly clamp the seal element 50 so that the seal element 50 can be seamlessly matched against the first conductive element 10, which effectively prevents the leakage of e-liquid through the gaps in between. In some embodiments, the extending end of the seal element 50 is tightly pressed to contact the inner wall of the installation hole 210 of the first conductive element 10, in order to prevent the e-liquid from leaking through the gap between the inner wall of installation hole 210 and the seal element 50 into the internal space of the electronic cigarette device. This effectively prevent leakage of e-liquid from the output electrode 1000 into the internal space of the electronic cigarette, which often causes damages to the internal components.

It is understood that the practical application of the present disclosure is not limited to the method by using an electrode holder 200 with an installation hole 210 and a conductive component 100 that is partly placed in the installation hole 210 to form an output electrode 1000. For example, in another embodiment, power supply equipment can include a pocket for the atomizer to be partly inserted into, and the pocket can include two separated conductive components 100 inside to form an output electrode 1000. Or, in another embodiment, the seal element 50 can include two separated sets of the first conductive element 10 and the second conductive element 30 to form an output electrode 1000 in order to prevent e-liquid leakage. All of these applications fall into the scope of the present disclosure.

It is understood that, in the practical application of the present disclosure, it is not limited to the above application in which the first conductive element 10 and the second conductive element 30 are detachable, but may also apply to other applications. For example, in another embodiment, an installation groove can be included along the circumferential direction of the outer surface of a conductive tube. The seal element 50 can be partly accommodated into the installment groove and tightly matched against the inner wall of the installment groove, and other part of the seal element 50 can extend outside the installation groove so that the conductive tube is separates into two parts, wherein one part forms the first conductive element 10 which is exposed outside, and the other parts can form the second conductive element 30 which is covered within the electronic cigarette device. As such, the seal element 50 can cover the second conductive element 30 to prevent e-liquid leakage.

Figure 3:
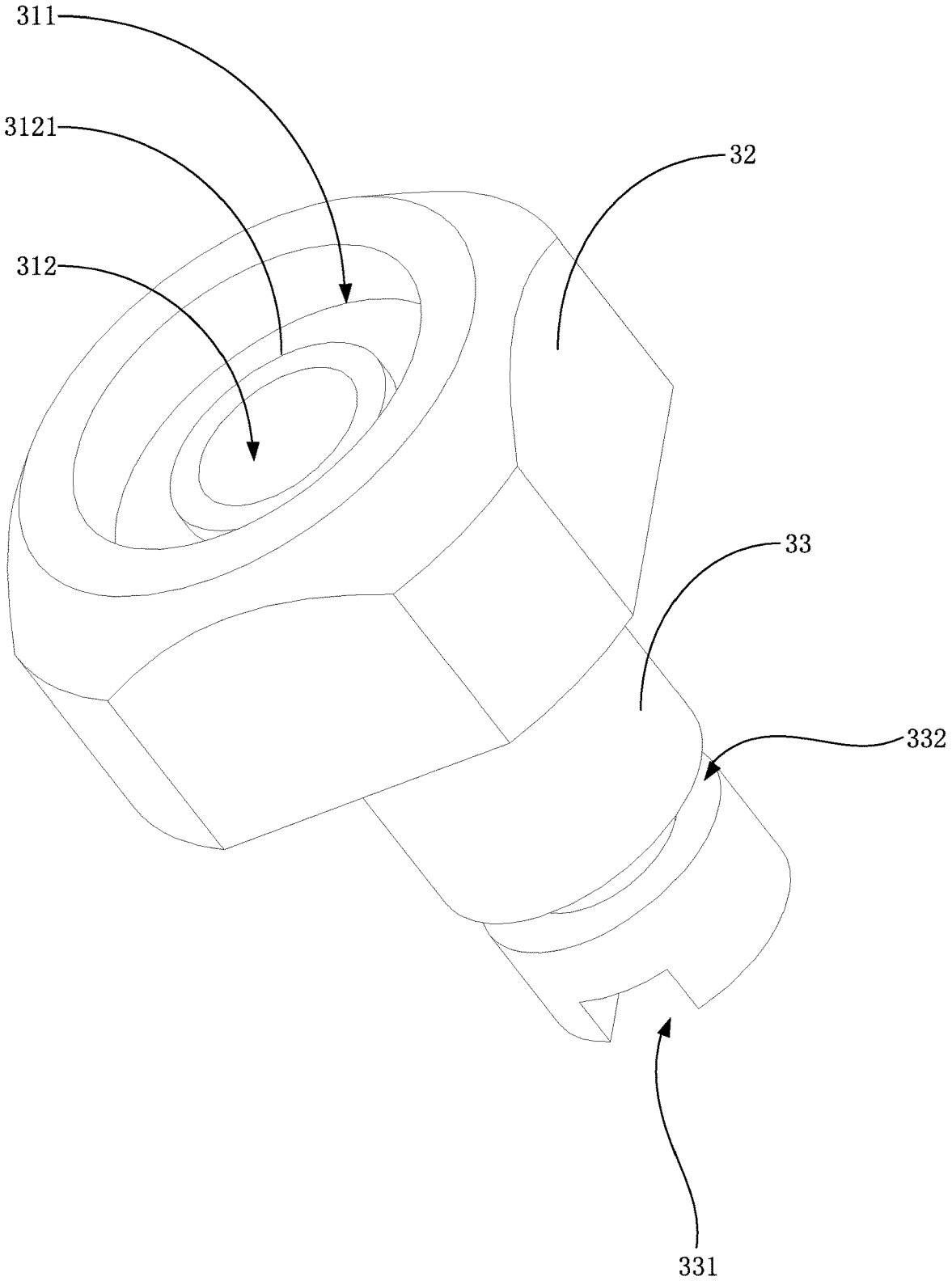
FIG. 3 is a schematic diagram of the second conductive element of the conductive component in the present disclosure.

In some embodiments, as shown in FIG. 1 or FIG. 3, the seal element 50 can be made of a flexible material. In some embodiments, the seal element 50 includes a sealing part 51 and a fixing part 52. The sealing part 51 can be clamped by the first conductive element 10 and the second conductive element 30, and the fixing part 52 can be fixed by the internal structure of the electronic cigarette device. In some embodiments, an elastic deformation part 53 can be formed between the sealing part 51 and the fixing part 52, and can cover the second conductive element 30 inside the electronic cigarette device. In the example embodiment, the seal element 50 is made of flexible material. When the external atomizer is installed in the electronic cigarette, the electrode assembly of the atomizer presses the first conductive element 10 to push the first conductive element 10 and the second conductive element 30 to move towards the installation hole 210 and thus forms a deformation of the elastic deformation part 53, which makes the conductive component 100 movable and elastic. In some embodiments, when the conductive component 100 is being pressed, the elastic deformation part 53 and the conductive component 100 move such that there are little to no gaps produced between the first conductive element 10, the second conductive element 30, and the seal element 50. Therefore, the present disclosure effectively prevents the leakage of e-liquid within the electronic cigarette.

In some embodiments, the thickness of sealing part 51 and the fixing part 52 is larger than the thickness of the elastic deformation part 53 such that when the conductive component is pressed by atomizer to move, the stress deformation is produced mainly within the elastic deformation part 53, which further prevents the detachment of the sealing part 51 from clamping by the first conductive element 10 and the second conductive element 30.

Figure 2:
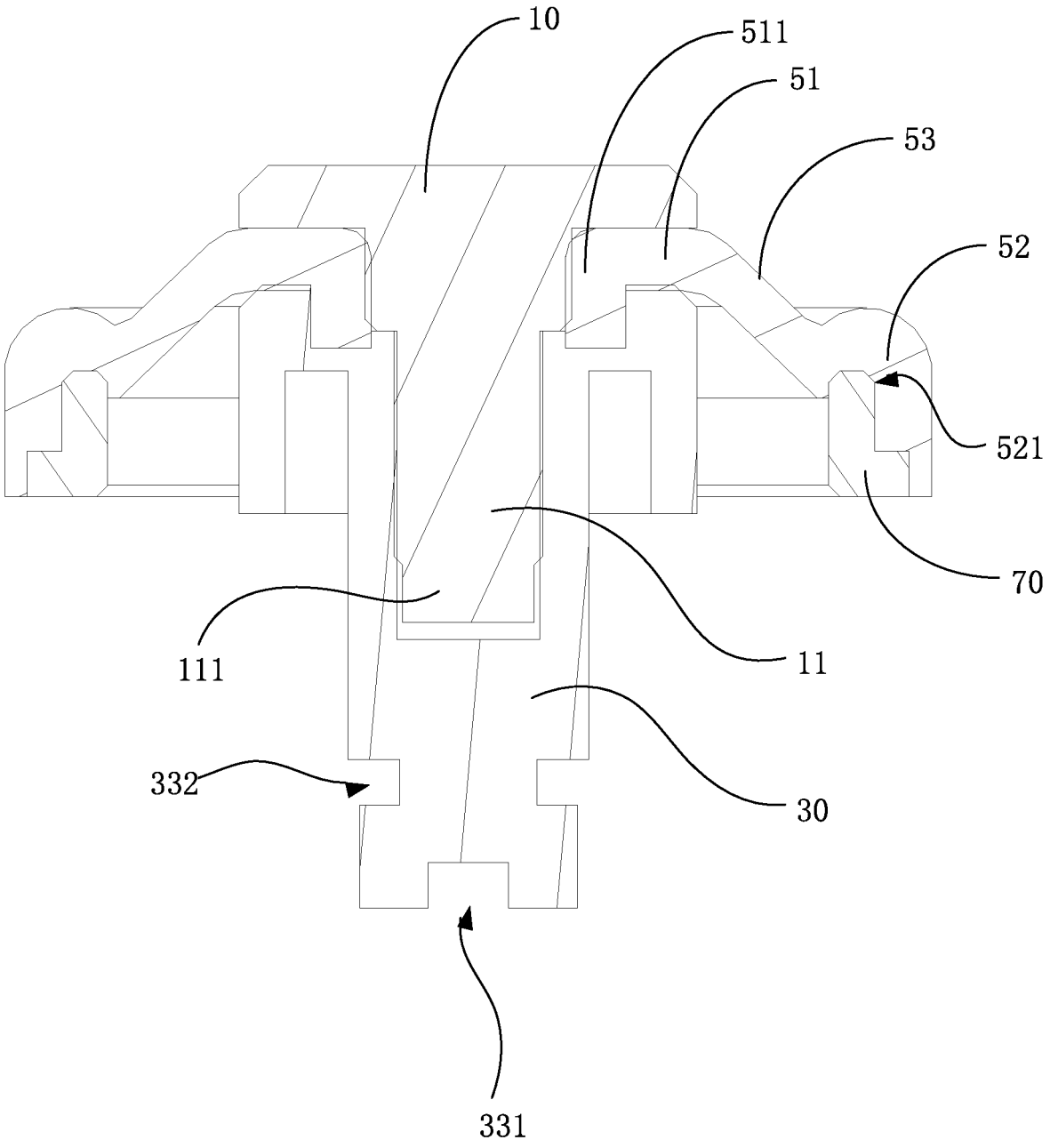
FIG. 2 is a sectional view of the connecting structure of the conductive component using for an electronic cigarette in present disclosure.

In an exemplary embodiment, as shown in FIG. 1 or FIG. 2, the second conductive element 30 includes an inserting hole 31, and the first conductive element includes a connecting bolt 11. The seal element 50 includes an avoidance hole 512 corresponding to the connecting bolt 11. The connecting bolt 11 can pass through the avoidance hole 512 and into the inserting hole 31 to fix the first conductive element 10 and the second conductive element 30 and tightly clamp the sealing part 51 between the first conductive element 10 and the second conductive element 30. In an exemplary embodiment, the first conductive element 10 has a connecting bolt 11, while the second conductive element 30 has a corresponding inserting hole 31. The avoidance hole 512 is provided in the center of the seal element 50 and configured to be inserted by the connecting bolt 11. In some embodiments, a diameter of the connecting bolt is slightly smaller than the diameter of the avoidance hole 512. For example, when the first conductive element 10 passes through the avoidance hole 512, the connecting bolt is tightly sleeved within the seal element 50, which effectively prevents the leakage of e-liquid from the gap between the avoidance hole 512 and the connecting bolt 11. In some embodiments, the connecting bolt 11 can be inserted into the inserting hole 31 so that the distance between the first conductive element 10 and the second conductive element 30 is less than the thickness of the sealing part 51 to tightly clamp the flexible seal element 50, preventing the detachment of the sealing part 51 from clamping by the first conductive element 10 and the second conductive element 30 when the conductive component 100 moves under external pressure.

It is understood that, in the practicable application, a simple swap of the connecting bolt 11 and the inserting hole 31 to accomplish the same goal and effect is also subject to the protection of the present disclosure.

In some embodiments, as shown in FIG. 1 or FIG. 3, the inserting hole 31 is a stepped sinking hole. In some embodiments, the sealing part 51 has a seal tube 511 placed at the edge of the avoidance hole 512 to be inserted into a large-diameter of the inserting hole 31. The connecting bolt 11 can be passed through the avoidance hole 512 into the seal tube 511 and reaches into the inserting hole 31. The seal tube 511 contacts the outer surface of the connecting bolt 11 elastically. To further prevent the leakage resulting from the detachment of the seal element 50 from clamping by the first conductive element 10 and the second conductive element 30 under external force, in the exemplary embodiment, the sealing part 51 has a seal tube 511 placed at the edge of the avoidance hole 512, and the hollow part of the seal tube 511 forms a seal channel with the avoidance hole 512, which effectively enlarges the sealing surface area when the connecting bolt is inserted in the avoidance hole 512. In some embodiments, the inserting hole 31 is a stepped sinking hole, and the outer diameter of the seal tube 511 is slightly larger than inner diameter of the part with a large-diameter 311 of the inserting hole 31. Therefore, during the installation, the seal tube 511 can be pressed to insert into a large-diameter 311 of the inserting hole 31, and the seal tube 511 will in turn press the inner wall of the large-diameter 311 of the inserting hole 31 to recover from the deformation such that the seal element 50 is tightly fixed on the second conductive element 30, which helps transition into the next processing position and the alignment and the fitting of the first conductive element 10. In some embodiments, when the connecting bolt 11 placed at the first conductive element 10 and passed through the seal tube 511 into the small-diameter 312 of the inserting hole 31, the seal tube 511 is tightly pressed against the inner wall of the part with a large-diameter 311. In some embodiments, when the conductive component 100 moves under external force, the seal tube 511 can be inserted into the large-diameter 311 of the inserting hole 31 to form a hook, which further effectively prevents the detachment of the sealing part 51 from clamping by the first conductive element 10 and the second conductive element 30.

Figure 5:
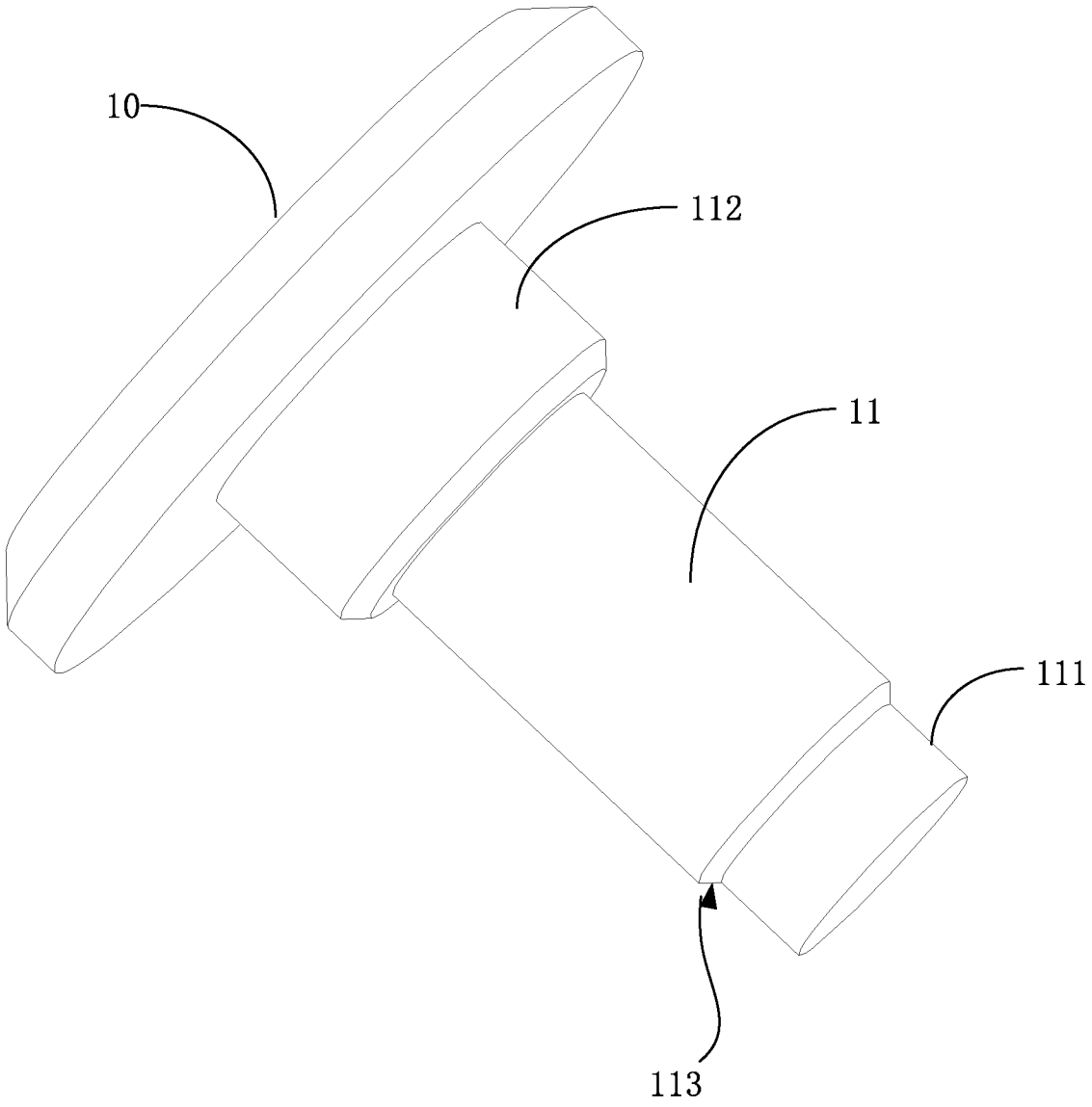
FIG. 5 is a schematic diagram of the first conductive element of the conductive component in the present disclosure.

In some embodiments, as shown in FIG. 1 or FIG. 5, the connecting bolt 11 includes a shaft shoulder 112, and the outer diameter of the shaft shoulder 112 is larger than the small-diameter 312 of the inserting hole 31. For example, the connecting bolt 11 can be passed through the avoidance hole 512 such that the shaft shoulder 112 contacts the edge of the small-diameter 312 of inserting hole 31 in order to accommodate the shaft shoulder 112 into the large-diameter 311 of the inserting hole 31 and tightly match the surface of the shaft shoulder 112 against the inner wall of the seal tube 511. In the exemplary embodiment, the seal element 50 includes a shaft shoulder 112 that contacts the edge of the part with a small-diameter 312 of the inserting hole 31 in order to effectively prevent the first conductive element 10 from overly inserting into the second conductive element 30 and in turn imposing too much pressure on the seal element 50 that likely crushes the seal element 50.

In the exemplary embodiment, as shown in FIG. 3, the edge of the small-diameter 312 of the inserting hole 31 includes a stop collar 3121, and a space between the outer ring of the stop collar 3121 and the inner wall of the large-diameter 311 of the inserting hole 31 forms a holding space. For example, when the seal tube 511 of the seal element 50 is inserted into the large-diameter 311 of the inserting hole 31, the end of the seal tube 511 is clipped into the holding space and contacts the stop collar 3121 elastically. In the exemplary embodiment, the edge of the small-diameter 312 of the inserting hole 31 facing the large-diameter 311 includes the stop collar 3121. The inner ring of the stop collar 3121 is configured to receive the connecting bolt 11, and the space between the outer ring of the stop collar 3121 and the inner wall of the large-diameter 311 of the inserting hole 31 forms a holding space. For example, when the seal tube 511 is inserted into the holding space, the inner wall of the end of the seal tube 511 contacts the inner ring surface of the stop collar 3121, which prevents the end of the seal tube 511 from edge curl because of the detachment of the seal tube 511 from clamping by the first conductive element 10 and the second conductive element 30 under external pulling force or because of the pressure causing by inserting the connecting bolt 11 into the seal tube 511.

In the exemplary embodiment, the diameter of the connecting bolt 11 gradually decreases from the protruding head to the protruding end. For example, the diameter of the protruding end of connecting bolt 11 is smaller, which helps inserting such connecting bolt into the seal tube 511 and the inserting hole 31. As the connecting bolt 11 is inserted, the inserted diameter of the connecting bolt 11 gradually increases such that it will fit tightly into the seal tube 511 and the inserting hole 31, which helps with the self-installation by users of the device. Further, inserting the protruding end with the smaller diameter from the beginning will guide the inserting of the connecting bolt 11 better and thus prevent being stuck.

It is understood that, in the practical application, the present disclosure is not limited to the application where the diameter of the connecting bolt gradually decreases along the extending direction. For example, as shown in FIG. 5, the protruding end of the connecting bolt 11 has an inserting head 111, and the diameter of which is smaller than the diameter of the connecting bolt 11. In some embodiments, the connecting part between the inserting head 111 and the connecting bolt 11 has a transitioning cambered surface 113. This application can accomplish the same guiding effect by having the inserting head 111 with a smaller diameter at the protruding end and effectively prevent the resistance when they come into contact with the transitioning cambered surface 113 between the inserting head 111 and the connecting bolt 11. In addition, the application in which the diameter of the part with a small-diameter 312 gradually decreases also falls into the scope of the present disclosure.

It is understood that, in the present disclosure, the first conductive element 10 and the second conductive element 30 can be attached by the interference fit method, or can be attached by other methods. For example, in some embodiments of the present disclosure, one of the first conductive element 10 and the second conductive element 30 has a connecting hole with female threads, and the other has a connecting tube with male threads setting at the protruding end of the connecting tube. The sealing part 51 of the seal element 50 is sleeved on the protruding head of the connecting tube, and the sealing part 51 is tightly clamped between the first conductive element 10 and the second conductive element 30 when the first conductive element is connected with the second conductive element through the thread engagement. This application effectively adjusts the pressure onto the seal element 50 by the first conductive element 10 and the second conductive element 30. In this embodiment, the first conductive element 10 can be screwed into the second conductive element 30, and thus prevents loosening caused by the long-term use of the first conductive element 10 and the second conductive element 30. The first conductive element 10 being screwed into the second conductive element 30 also allows disassembling the first conductive element 10 from the second conductive element 30, which can help with repairs and maintenance.

In the exemplary embodiment, as shown in FIG. 2, the seal element 50 is of a circular truncated cone shape. For example, when the first conductive element 10 of the conductive component 100 moves towards the power supply equipment under the pressure of atomizer, the top of the circular truncated cone moves gradually until it becomes flat to the down edge of circular truncated cone, where an elastic deformation part 53 with sloped shape deforms as an elastic deformation part 53 with flat shape. The elastic deformation part 53 can be tightly pressed with the seal element 50 between the first conductive element 10 and the second conductive element 30 under the elastic resilience, which further prevents detachment of the seal element 50 from clamping by the first conductive element 10 and the second conductive element 30. In addition, when the e-liquid flows into the installation hole 210, the elastic deformation part 53 with sliding circular truncated cone shape can push the e-liquid to the extending end of the circular truncated cone, which effectively prevents the over-gathering of e-liquid or cooling water that likely causes the short circuit of the conductive component 100 and electrode holder 200.

It is understood that, in the practical application, the elastic deformation part 53 is not limited to circular truncated cone shape. For example, in another embodiment in the present application, the elastic deformation part 53 may also be flat. For example, when the elastic deformation part 53 is installed in the power supply equipment, the extending end of elastic deformation part 53 is tightly clamped in a position where it is slightly underneath between the first conduct element 10 and the second conductive element 30. This application also falls within the scope of the present disclosure.

In the exemplary embodiment, as shown in FIG. 5, the output electrode 1000 includes a clamping ring 70, which encloses the extending end of the seal element 50. In the exemplary embodiment, the clamping ring is made of rigid materials. For example, as the extending end of the seal element 50 is tightly fixed, the clamping ring 70 made of rigid materials is shaped and further presses the seal element 50, which effectively prevents the deformation of the flexible seal element 50 as the deformation will result in the detachment of the seal element 50 or generate gaps in between.

In the exemplary embodiment, as shown in FIG. 2, a receiving groove 521 is provided on one side of the seal element 50 facing the second conductive element 30. In some embodiments, the clamping ring 70 is tightly fitted in the receiving groove 521, and one side of which is either flat with or extending beyond the edge of the receiving groove 521. For example, a receiving groove 521 is provided on one side of the seal element 50 facing the second conductive element 30. In some embodiments, the clamping ring 70 can be tightly fitted in the receiving groove 521, and the clamping ring 70 and the seal element 50 are integrated molding. For example, when the seal element 50 is being tightly clamped, the clamping ring 70 which is flat with the edge of the receiving groove 521 or beyond the receiving groove 521 contacts the inner wall of the power supply equipment. This will tightly press the side of the seal element 50 facing the installation hole 210 and thus effectively prevent the leakage of e-liquid. In some embodiments, the receiving groove 521 and integrating molding the seal element 50 with the clamping ring 70, can help fix positioning, alignment, and help with the installation of the device.

The exemplary embodiment also provides an output electrode 1000 using for an electronic cigarette. The output electrode 1000 includes the conductive component 100 depicted in the above embodiments. Because the electronic cigarette applies the same technical designs, it embraces all the favorable effects and advantages in the above technical design, which will not be reiterated here.

Figure 6:
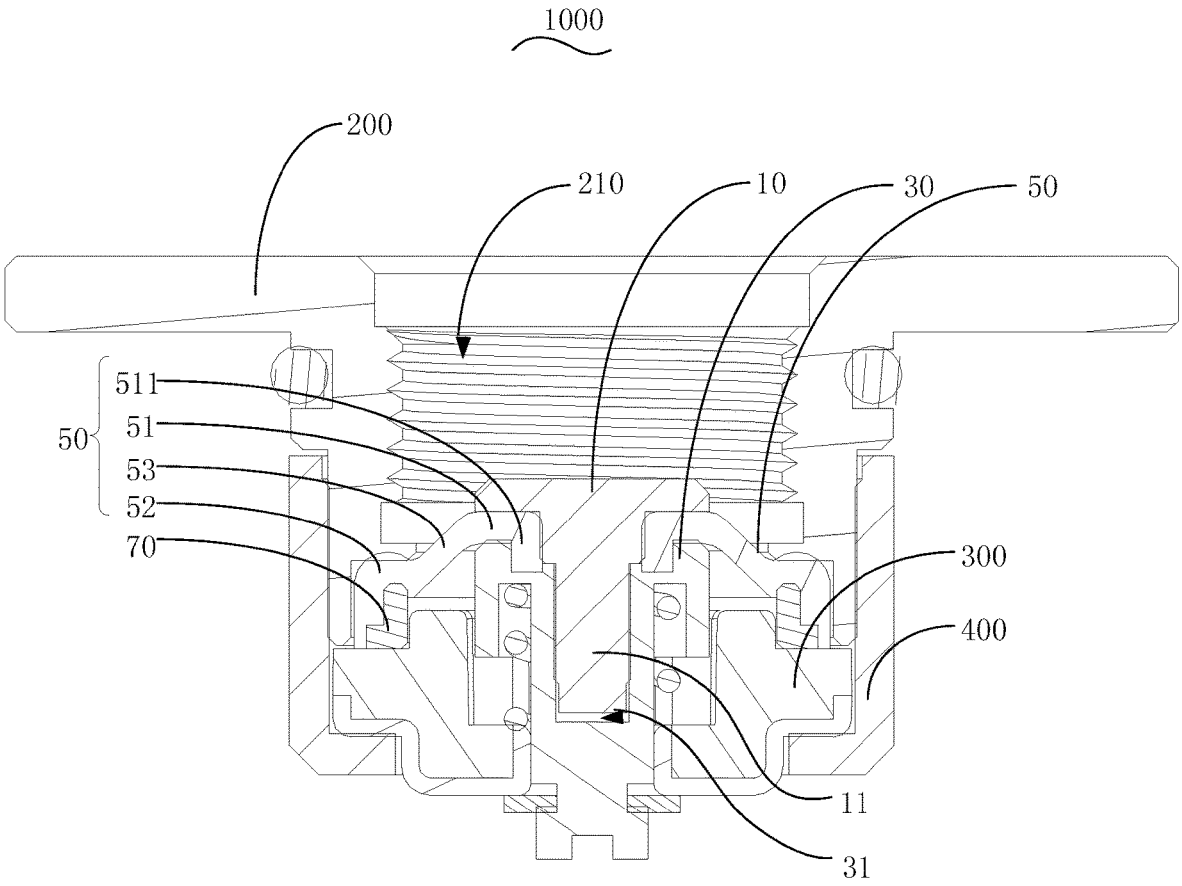
FIG. 6 is a sectional view of the connecting structure of the output electrode using for an electronic cigarette in the present disclosure.

Further, as shown in FIG. 6, in the exemplary embodiment, the output electrode 1000 includes a locking cover 400, one end of which covers and partly presses the insulation element 300 so that it contacts the end surface of electrode holder 200, with the other end of the locking cover 400 being sleeved on the outer surface of the electrode holder 200. In some embodiments, the locking cover 400 includes an avoidance opening corresponding to the conductive component 100 from which the conductive component 100 is exposed. For example, the locking cover 400 covers one side of the insulation element 300 separated away from the seal element 50 onto the surface of electrode holder 200, and the other side is sleeved on the outer surface of electrode holder 200, which effectively fixes the insulation element 300, the seal element 50, and the conductive component 100 within the electrode holder 200 and combines them as a combination. In some embodiments, during manufacturing and installation, the combination can be smoothly transit to next position and thus avoid loss of components and gaps among components, which may likely result in leakage due to the lack of preciseness. Installing the combination to the electronic cigarette device at the next position can make the assembly easier and at the same time ensure preciseness and improve the quality rate of the products.

In the exemplary embodiment, the locking cover 400 can be tightly pressed together with the electrode holder 200, or the locking cover 400 can be connected with the electrode holder 200 through threads, or the locking cover 400 can be connected with the electrode holder 200 with buckle connection, or the locking cover 400 can be connected with the electrode holder 200 with connecting bolts. In the exemplary embodiment, the locking cover 400 is connected to the electrode holder 200 with threads forming detachable connections which can help the user attach and detach the locking cover 400. The detachable connections can also allows adjustment of the threading, which effectively prevents imposing too much pressure onto and resulting in the collapse of the seal element 50.

It is understood that the practical application of the present disclosure is not limited to methods mentioned above. For example, in other exemplary embodiment of the present disclosure, the locking cover 400 and electrode holder 200 can be pressed or welded together to ensure the strength and preciseness of the connection.

In some embodiments, the locking cover 400 is made of conductive material, and has at least one concave groove that allows the welding of the wires. For example, the locking cover 400 is made of conductive material, and its side separated away from the seal element 50 also has two concave grooves for wire welding, which helps the consumers to weld the wires. In some embodiments, the locking cover 400 can be connected with the electrode holder 200 with threads, which conducts the electricity and thus does not need extra wires and saves space for wires. In addition, during the installation, it may be convenient to insert tools into the two concave grooves and then rotate the locking cover 400 in case the threading strength is too weak and the locking cover 400 and the electrode holder 200 are loosened after a long time.

It is understood that the practical application is not limited to having a concave groove for welding in the locking cover 400. For example, in another exemplary embodiment, a wiring pin may be set around the electrode holder 200 and tighten the wiring pin with the locking cover 400 to connect the electrode holder 200 and the wiring pin electronically, and place a wiring hole that allows users to weld the wires. This application is equally subject to the protection of the present disclosure.

In some embodiments, as illustrated in FIG. 5, in the exemplary embodiment, to prevent short circuit caused by direct contact between the conductive component 100 and the locking cover 400, the insulation element 300 can further include a separating convex stage surrounded the conductive component 100. In some embodiments, the separating convex stage can be inserted into the avoidance opening to separate the conductive component 100 from the locking cover 400.

Figure 4:
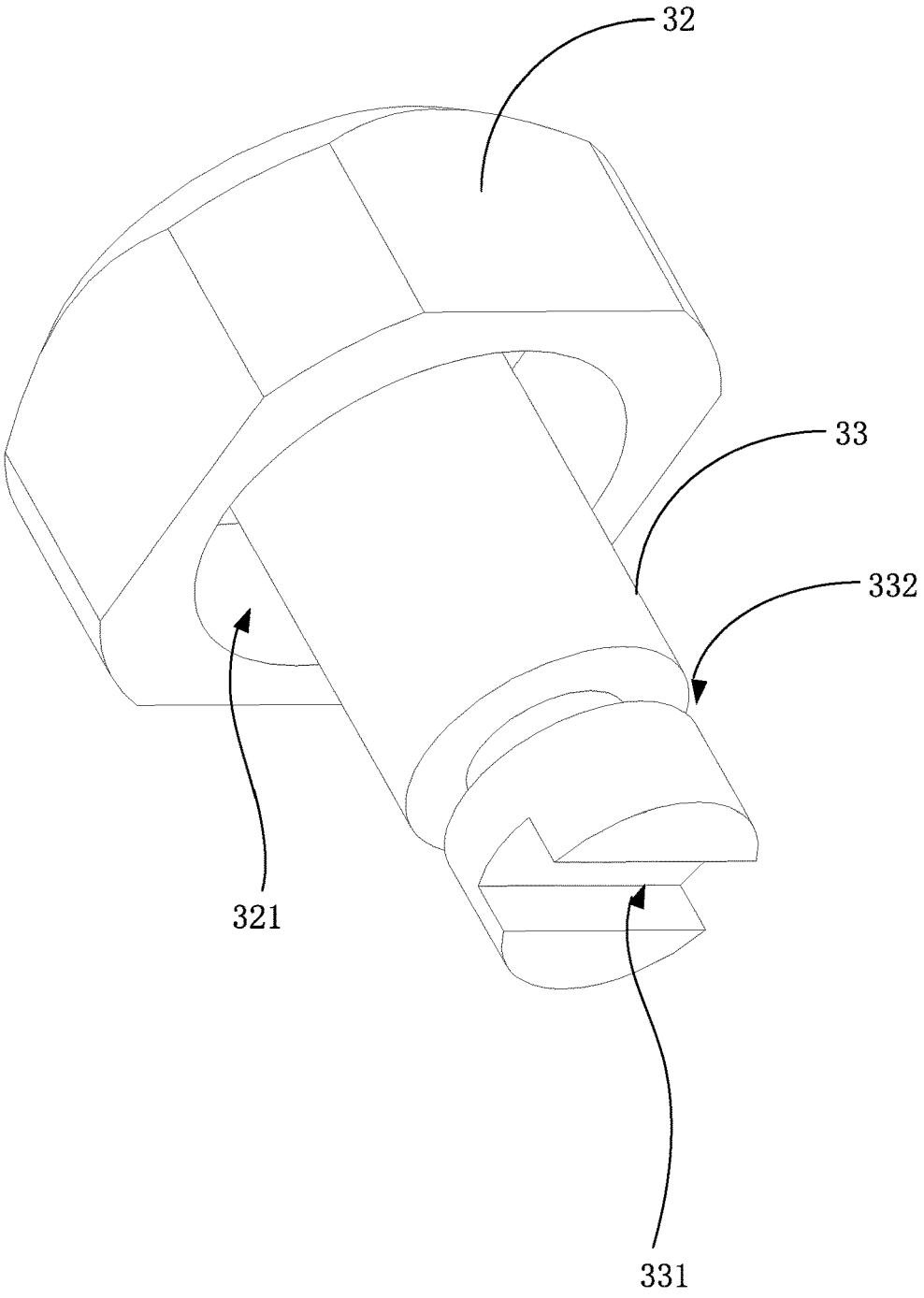
FIG. 4 is a schematic diagram of the second conductive element of the conductive component in the present disclosure from a different angle.

In the exemplary embodiment, as illustrated in FIGS. 3 through 5, the second conductive element 30 includes a larger end 32 and a smaller end 33 that is attached to the larger end 32. The larger end 32 is attached to the first conductive element 10, and the smaller end 33 passes through the insulation element 300 and exposes through the avoidance aperture. The smaller end 33 can include a wiring groove 331 or a wiring hole so that the consumers can place the wire into the wiring groove 331 or insert the wire to the wiring hole for welding and to seal it. For example, the smaller end 33 slidablely inserts into the avoiding hole. The outer diameter of the larger end is larger than the avoiding hole, thus the larger end can contact with the edge of the avoiding hole to restrict the sliding of the smaller end 33 in the avoiding hole, which effectively prevent too much pressure imposing on the conductive component 100 and prevent over sliding of the conductive component 100 into the power supply equipment causing by external force. For example, with a wiring groove 331 or a wiring hole setting on the smaller end 33, the exemplary embodiment allows to place the wire in the wiring groove 331 or wiring hole and then solder tin during welding, which eases the processing and makes sure the welding spot is not exposed outside the conductive component 100 minimizing false welding and welding sealing off and improving the processing preciseness.

It is understood that, in the practical application, the larger end 32 may also be formed by setting flange or stop block along the outer surface of the smaller end 33. Alternatively, the conductive component 100 can be cut into two ends that have different outer diameters to form the larger end 32 and the smaller end 33. All of these applications are subject to the protection of the present disclosure.

Further, as illustrated by FIG. 5, in the exemplary embodiment, there is an elastic element between the end surface of the larger end 32 and the insulation element 300. The elastic element can be made of spring, elastic plastics, elastic silicone gel, or the like. With the elastic element contacting the end surface of the larger end 32 and the insulation element 300 elastically, it can improve the springback performance of the conductive component 100 effectively.

Further, as illustrated by FIG. 5, in the exemplary embodiment, an accommodating groove 321 is provided at the interface between the smaller end 33 and the larger end 33. For example, the accommodating groove 321 extends in a direction from the larger end 32 to the smaller end 33, and extends towards to the larger end 32. In this exemplary embodiment, with the providing of the accommodating groove 321, the elastic element is sleeved on the smaller end 33, and one end of which is accommodated inside the accommodating groove 321 and contacts the bottom wall of accommodating groove 321 elastically, with the other end contacts the inner wall of the power supply equipment. This example embodiment effectively prevents deviation of the elastic element when the conductive component 100 moves along the avoidance opening.

Further, as illustrated in FIGS. 3 through 5, in this exemplary embodiment, a clipping groove 332 is set on the outer periphery of the smaller end 33 for inserting external snap ring. For example, the clipping groove 332 is placed at a position of the smaller end 32 separated away from the larger end 32. During installation, for example, passing the smaller end 33 through the avoidance hole 512 into the power supply equipment and placing the snap ring into the clipping groove 332 in order to tightly locks part of the smaller end 33 into outer edge of the avoidance hole 512 separated away from the larger end 32. This exemplary embodiment can save the extra length of the smaller end 33 for it to insert into the deeper section of avoidance hole 512 and effectively prevents the conductive component 100 slipping off from the avoidance hole 512 under elasticity.

Further, as illustrated in FIG. 5, in the exemplary embodiment, a corresponding avoidance groove is set on the insulation element 300 corresponding to the outer surface of the larger end 32 to allow the larger end 32 to move along the axis direction within the avoidance hole 512 under external force. For example, when a second conductive element moves along the installation hole 210 under external force, the avoidance groove provides positioning and guiding effects for the larger end 32, which effectively minimizes the deviation of conductive component 100 due to uneven force.

The present disclosure also provides an electronic cigarette, which includes an output electrode 1000. The detail structure of the output electrode 1000 refers to the above embodiments. Because the electronic cigarette applies the same technical designs, it embraces all the favorable effects and advantages in the above technical design, which will not be reiterated here.

The above embodiments are preferred embodiments of the present disclosure and are not intended to limit the patent scope of the present disclosure. Any equivalent structures made according to the description and the accompanying drawings of the present disclosure without departing from the idea of the present disclosure, or any equivalent structures applied in other relevant technical fields, directly or indirectly, are intended to be included in the scope of the protection of the present disclosure.

What is claimed is:

1. A conductive component of an electronic cigarette, the conductive component comprising:

a first conductive element;

a second conductive element; and a seal element comprising a first end and a second end, wherein the seal element is tightly clamped by the first conductive element and the second conductive element, wherein the first conductive element passes through the seal element and establishes an electrical connection with the second conductive element, wherein a portion of the seal element extends outwards, wherein when the first end of the seal element is fixed, the seal element partly separates the first conductive element and the second conductive element so that the first conductive element is exposed and electronically connected with an external load, and the second conductive element is covered by the seal element within the electronic cigarette and electronically connected with an internal component of the electronic cigarette.

2. The conductive component of claim 1, wherein the seal element comprises a flexible material.

3. The conductive component of claim 1, wherein the seal element further comprises:

a sealing part;

a fixing part; and an elastic deformation part, wherein the sealing part is clamped by the first conductive element and the second conductive element, wherein the first end of the seal element which is fixed by an internal structure of the electronic cigarette forms the fixing part, wherein the elastic deformation part is formed between the sealing part and the fixing part.

4. The conductive component of claim 3, wherein the first conductive element comprises an inserting hole and the second conductive element comprises a connecting bolt, wherein the seal element further comprises an avoidance hole corresponding to the connecting bolt, wherein the connecting bolt is configured to pass through the avoidance hole and into the inserting hole to connect the first conductive element and the second conductive element, wherein the sealing part is tightly clamped between the first conductive element and the second conductive element.

5. The conductive component of claim 4, wherein the inserting hole is a stepped sinking hole.

6. The conductive component of claim 4, wherein the sealing part comprises a seal tube placed at an edge of the avoidance hole and is configured to be inserted into a large-diameter of the inserting hole.

7. The conductive component of claim 6, wherein the connecting bolt passes through the avoidance hole and into the seal tube, and the seal tube elastically contacts an outer surface of the connecting bolt.

8. The conductive component of claim 6, wherein the connecting bolt comprises a shaft shoulder, wherein an outer diameter of the shaft shoulder is larger than a small-diameter of the inserting hole, wherein when the connecting bolt passes through the avoidance hole and the shaft shoulder contacts an edge of the small-diameter of the inserting hole, the shaft shoulder is accommodated into the large-diameter of the inserting hole and an outer surface of the shaft shoulder contacts an inner wall of the seal tube.

9. The conductive component of claim 8, further comprising a stop collar on the edge of the small-diameter of the inserting hole, wherein a space between an outer surface of the stop collar and an inner wall of the large-diameter of the inserting hole forms a holding space such that when the seal tube of the seal element is inserted into the large-diameter of the inserting hole an end of the seal tube is inserted into the holding space and contacts the stop collar elastically.

10. The conductive component of claim 4, wherein a diameter of the connecting bolt gradually decreases from a protruding head of the connecting bolt to a protruding end of the connecting bolt, wherein the protruding end of the connecting bolt comprises an inserting head that includes a diameter that is smaller than the diameter of the connecting bolt, and a connecting part between the inserting head and the connecting bolt comprises a transitioning cambered surface.

11. The conductive component of claim 4, wherein the first conductive element comprises a connecting hole that includes female threads, and the second conductive element comprises a connecting tube that includes male threads, wherein the male threads are at a first end of the connecting tube, wherein a sealing part of the seal element is sleeved at a second end of the connecting tube, wherein the sealing part is configured to be tightly clamped between the first conductive element and the second conductive element when the first conductive element is connected with the second conductive element via a thread meshing.

12. The conductive component of claim 3, wherein the elastic deformation part comprises a circular truncated cone shape.

13. The conductive component of claim 1, further comprising a clamping ring that is configured to enclose the first end of the seal element.

14. The conductive component of claim 13, wherein the seal element further comprises a receiving groove on a side that faces the second conductive element, and at least part of the clamping ring is tightly fitted in the receiving groove.

15. An output electrode of an electronic cigarette, the output electrode comprising:

a conductive component, wherein the conductive component comprises:

a first conductive element;

a second conductive element; and a seal element comprising a first end and a second end, wherein the seal element is tightly clamped by the first conductive element and the second conductive element, wherein the first conductive element passes through the seal element and establishes an electrical connection with the second conductive element, wherein a portion of the seal element extends outwards, wherein when the first end of the seal element is fixed, the seal element partly separates the first conductive element and the second conductive element so that the first conductive element is exposed and electronically connected with an external load, and the second conductive element is covered by the seal element within the electronic cigarette and electronically connected with an internal component of the electronic cigarette.

16. The output electrode of claim 15, wherein the seal element further comprises:

a sealing part;

a fixing part; and an elastic deformation part, wherein the sealing part is clamped by the first conductive element and the second conductive element, wherein the first end of the seal element which is fixed by an internal structure of the electronic cigarette forms the fixing part, wherein the elastic deformation part is formed between the sealing part and the fixing part.

17. The output electrode of claim 16, wherein the first conductive element comprises an inserting hole and the second conductive element comprises a connecting bolt, wherein the seal element further comprises an avoidance hole corresponding to the connecting bolt, wherein the connecting bolt is configured to pass through the avoidance hole and into the inserting hole to connect the first conductive element and the second conductive element, wherein the sealing part is tightly clamped between the first conductive element and the second conductive element.

18. The output electrode of claim 17, wherein the inserting hole is a stepped sinking hole.

19. An electronic cigarette comprising an output electrode that comprises a conductive component, wherein the conductive component comprises:

a first conductive element;

a second conductive element; and a seal element comprising a first end and a second end, wherein the seal element is tightly clamped by the first conductive element and the second conductive element, wherein the first conductive element passes through the seal element and establishes an electrical connection with the second conductive element, wherein the unclamped a portion of the seal element extends outwards, wherein when the first end of the seal element is fixed, the seal element partly separates the first conductive element and the second conductive element so that the first conductive element is exposed and electronically connected with an external load, and the second conductive element is covered by the seal element within the electronic cigarette and electronically connected with an internal component of the electronic cigarette.

20. The electronic cigarette of claim 19, wherein the seal element further comprises:

a sealing part;

a fixing part; and an elastic deformation part, wherein the sealing part is clamped by the first conductive element and the second conductive element, wherein the first end of the seal element which is fixed by an internal structure of the electronic cigarette forms the fixing part, wherein the elastic deformation part is formed between the sealing part and the fixing part.

* * * * *